United States Patent [19]

Stelniceanu

[11] Patent Number: 4,936,242

[45] Date of Patent: Jun. 26, 1990

[54] INFLATABLE CATAMARAN KIT

[76] Inventor: Jacques Stelniceanu, 6 rue Beaure paire, Paris, France, 75010

[21] Appl. No.: 251,796

[22] Filed: Oct. 3, 1988

[30] Foreign Application Priority Data

Feb. 13, 1987 [FR] France ..... 87 01811

[51] Int. Cl.[5] ..... B63H 9/04

[52] U.S. Cl. ..... 114/352; 114/39.2; 114/345; 114/61

[58] Field of Search ..... 114/61, 352, 354, 345, 114/356, 357, 39.1, 39.2, 162

[56] References Cited

U.S. PATENT DOCUMENTS

| | | | |
|---|---|---|---|
| 3,473,502 | 10/1969 | Kamp | 114/61 |
| 3,608,112 | 9/1971 | Irgens | 114/354 |
| 3,682,123 | 8/1972 | Edwards | 114/345 X |
| 4,136,414 | 1/1979 | Popkin | 114/39.1 |
| 4,766,830 | 8/1988 | Kunz | 114/345 |

*Primary Examiner*—Joseph F. Peters, Jr.
*Assistant Examiner*—Edwin L. Swinehart
*Attorney, Agent, or Firm*—Louis E. Marn

[57] ABSTRACT

In a preferred embodiment, a sail-boat type wind-surfing catamaran as a kit of disassembled parts having inflatable deflated pneumatically-sealed pontoons, attachable and anchorable onto transversely extending detachable forwardly and rearwardly beams by detachably mountable and anchorable on the transversly extending beams, the band circumscribing the respective inflated pontoons when mounted, at-least a portion of each of the beams extending above the respective pontoons when inflated, the floor being mountable between and detachably anchored on the forwardly and rearwardly beams by forwardly to rearwardly-extending elongated supports extending between and detachably anchored on the forwardly and rearwardly beams, with a wing-rudder mounted in a fixed position on a distal end of an elongated wing-mounting rod-structure of which the proximal rod-end is detachable mounted between the pontoons and anchored on the rearwardly transverse beam, with supplemental support thereto extending from rearward portions of the pontoons, with a mast head's masthead-heel mounted within a through-space in spaced-apart panels extending lengthwise of the pontoons, and with a detachably mountable and anchorable daggerboard well-structure and detachable daggerboard mounted therein, mounted also within the through-space between the floor panels, the proximal ends of the bands having enlarged heads insertable into detachable; band-anchoring through-space formed in opposite ends of the transverse beams when the pontoons are in a deflated state to be non-removable band-heads when the pontoons are inflated with the bands tightly holding the inflated pontoons, and with a split-off band distal end being mounted and anchored to an intermediate portion of the same transverse beam, there being a water-tight bag and support structure thereof mounted onto a forward portion of the forward transverse beam.

5 Claims, 3 Drawing Sheets

FIG.3
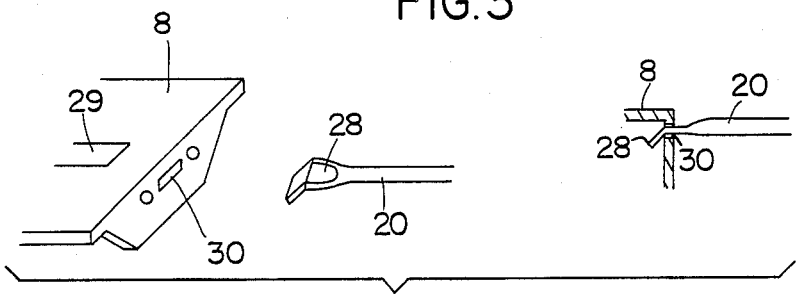
FIG.4
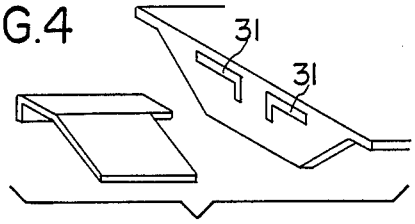
FIG.5
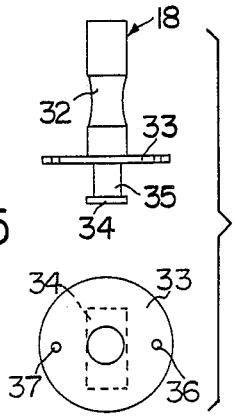
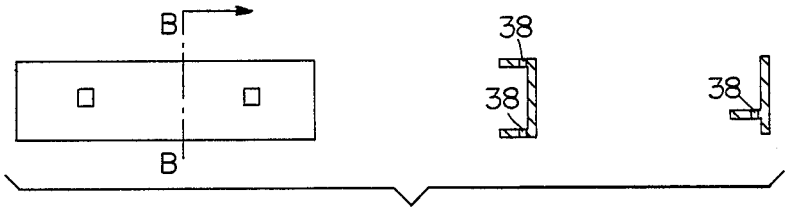
FIG.6
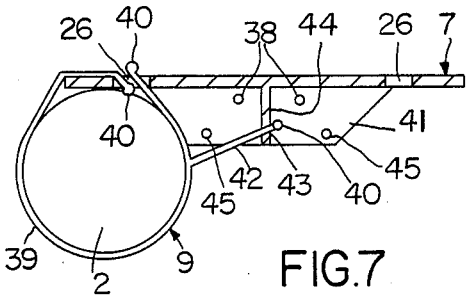
FIG.7
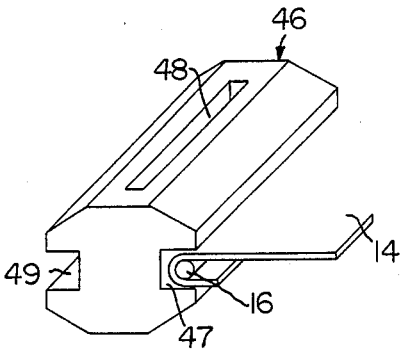
FIG.8

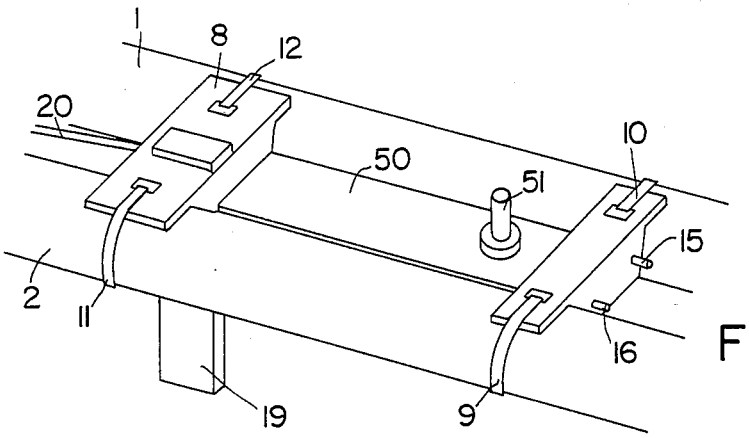
FIG.9
FIG.10
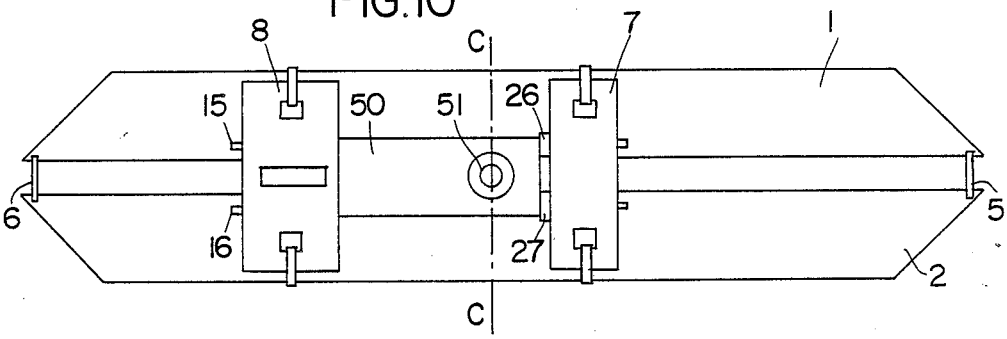
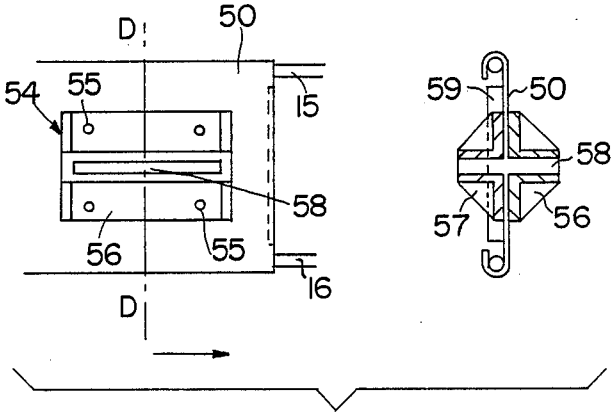
FIG.11
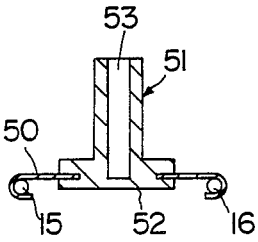
FIG.12

INFLATABLE CATAMARAN KIT

This invention is directed to a catamaran kit for detachably intermittently assembling and disassembling component parts thereof.

PRIOR ART STATEMENT

While no relevant nor suggestive prior art was located, patents of interest include general type catamaran patents such as integral permanent catamaran hulls and other structures thereof of U.S. Pat. No. 3,614,937 inclusive of catamaran rigid boat-like hulls, with a floor, and U.S. Pat. No. 3,031,692 having transverse beans and a floor and permanent and rigid catamaran hull, and U.S. Pat. No. 2,950,699 having cross-beams and a floor mounted across the permanent pontoons, and U.S. Pat. No. 2,556,619 disclosing transverse beams, a floor and the pontoons, and U.S. Pat. No. 2,916,748 disclosing bands around the pontoons and transverse beams, and U.S. Pat. No. 2,916,718 likewise disclosing bands and pontoons and transverse beams, and U.S. Pat. No. 4,406,239 disclosing the catamaran hulls, the transverse beams, the floor, guidable variable rudders, intermediate free-space between floor panels, and a mounted masthead. Accordingly, none of these patents relate to a kit of intermittently attachable and mountable and disabling parts nor of inflatable pontoons nor other integral parts of the present invention.

BACKGROUND TO THE INVENTION

Prior to the present invention, to the best of the inventor's knowledge, there has never existed a catamaran having alternately inflatable and deflatable pontoons, nor one in kit form adapted to intermittent and easy assembling and disassembling, much less a wind-surfacing catamaran kit. Accordingly, there has been strict limitations on the ability of fun-loving surfers to extend their art to catamaran surfing, much-less to catamaran wind-surfing. A major problem heretofore to the concept and implementing of a kit that could be assembled to a full-fledged wind-surfacing catamaran, has been the required sturdiness due to the great stress to which the wind-surfing catamaran would be subjected; lack of stabilility and sturdiness could result in major accidental injury to the surfer, as well as lack of utility for such catamaran.

THE OBJECTS

Accordingly, objects of the invention are directed to overcoming and/or avoiding one or more difficulties above-noted, together with obtaining other advantages and utilities.

Another object is to obtain a catamaran of conventional utility or alternately useful as a wind-surfing catamaran, of a compactable disassemble kit intermittently and easy to be assembled into a sturdy and strong structure.

Another object is to obtain preceding objects by use of a mere few part of simple construction and low cost.

Other objects become apparent from the preceding and following disclosure.

BROAD DESCRIPTION

Broadly the invention may be described as a catamaran in kit form, conventionally having typical spaced-apart pontoons. Likewise the present combination includes a floor extending above an intermediate space between the spaced-apart pontoons. Likewise, each of the spaced-apart pontoons conventionally are anchored by at least one forward band and one rearward band for each of the spaced-apart pontoons, to a floor. The invention arises from improvement to these prior noted parts/element, together with additional features and/or parts/elements. In particular, the kit is adapted for intermittent alternate assembling and disassembling from anchored states one part to another. The pontoons are detachable one detachable pontoon from the other detachable pontoon, by the band being detachable as detachably mountable and anchorable(lockably-securable) bands. Each detachable inflatable pontoon is pneumatically-sealed and alternately inflatable and deflatable inflatable between a collapsed foldable state and an inflated substantially rigid-hull state. At-least one detachable beam of the transverse support beams is detachably mountable and anchorable to the pontoons at a forward portion of the pontoons by the detachably mountable and anchorable bands. At-least another detachable beam of the support beams is detachably mountable and anchorable to the pneumatically sealed pontoons in the inflated state at the rearward portion attached at the detachable beams opposite ends to the spaced-apart pontoons by the bands. In a mounted and inflated and secured state the detachable pontoons are substantially parallel to one-another, with each detachable pontoon having a pontoon longitudinal axis and having an outer circumference (the same as conventional pontoons) extending around the pontoon longitudinal axis. At-least one forward transversely-extending beam and at-least one rearward transversely-extending beam each have at-least a portion of each of the opposite ends thereof extending above the respective adjacent portions of the pontoons, extending transversely to the pontoons's longitudinal axis. The floor is detachably mountable and anchorable to and between the afore-stated at-least one forward transversly-extending beam and the afore-stated at-least one rearward transversely-extending beam relative to the spaced-apart pontoons. Accordingly, in the broadest concept, the improvement in kit form include as a part of the combination the alternately inflatable and deflatable detachable pneumatically-sealed pontoons, the detachable and anchorable bands, the afore-stated at-least one forward detachable beam and the afore-stated rearward detachable beam, and the detachable floor.

In one preferred embodiment, the improvement includes additionally at-least first and second elongated support structures each having a support-structure longitudinal axis and each having elongated support-structure proximal and distal ends at opposite ends thereof; additionally the first and second elongated support structures extend between and are mounted and anchored detachable to solely the afore-stated forwardly located detachable beam and the afore-stated reawardly-located other detachable beam. The proximal ends thereof are detachably anchorable on solely the afore-stated forwardly-located detachable beam. The distal ends thereof are detachably anchorable on solely the afore-stated rearwardly-located detachable beam. The floor is a structure attached to and anchored solely on at-least one of the first and second elongated support structures. In this preferred embodiment above-described, the kit additionally includes therefor the first and second support structures, together with the other stated-features.

In another preferred embodiment, as a part of the improvement, there is at-least one detachably mountable and anchorable fixed-position wing-rudder sub-combination and mechanism thereof for setting and maintaining solely a fixed-course (not a variable steerable rudder) of steering a course of said spaced-apart pontoons. The fixed-position wing-rudder sub-combination and mechanism thereof are mountable and securable (anchorable) to at-least one of the spaced-apart pontoons, the afore-stated rearward detachable beam, and the floor. In this preferred embodiment, the kit additionally includes the fixed-position wing-rudder structures and mechanisms thereof, together with other afore-stated features.

In a further preferred embodiment, more preferably the wing-rudder is mounted at-least principally on the afore-stated rearward detachable beams, critically providing a single guidance from a point mid-way between the pontoons, rearwardly thereof, thereby providing improved guidance during wind-surfing.

In a further preferred embodiment, the wing-rudder structures and mechanism thereof includes an elongated wing-mounting structure, typically a rod, having opposite wing-mounting structure-proximal end and wing-mounting structure-distal end. The wing-mounting structure-proximal end is mountable detachably and on the aforestated rearward transversly-extending beam. A wing-structure (immovable rudder) is critically immovably detachably mountable on the wing-mounting-structure distal end.

In another preferred embodiment, the afore-stated rearward portion of the spaced-apart catamaran pontoons each has a a rearward distal end. A detachably mountable and anchorable accessory structure is mountable on and between the spaced-apart pontoons at about the reaward distal ends thereof. The accessory structure when mounted, provides supplementary support to the elongated wing-mounting structure when in a mounted state. In this preferred embodiment, the kit further includes the accessory structure.

In a still other preferred embodiment, the floor has a length dimension with a length axis thereof, and the floor is mountable with the length axis extending substantially parallel to the pontoon longitudinal axis above-described. The floor has opposite left and right lateral edges extending along said length axis. Additionally the floor includes a floor through-space through the floor, with the through-space thereof circumscribed by through-space-forming structure, with the through-space located about mid-way between the opposite left and right lateral edges. There is also included a mast head and a masthead-heel thereof. The masthead-heel is detachably mountable and anchorable on the through-space forming structure. In this embodiment, the kit further includes the masthead and the masthead-heel thereof.

In a further preferred embodiment, the floor has a length dimension along a floor longitudinal axis extending substantially in parallel with the pontoons's longitudinal axes, and the floor includes at-least two spaced-apart floor-panels extending along the floor longitudinal axis and defining (forming) the afore-stated through-space to extend substantially parallel with the floor longitudinal axis. More preferably, the masthead-heel is mountable and securable within this afore-stated through-space with inside lateral edges to the adjacent central panels providing the mounting and securing (locking) structure for opposite-side edges of the masthead-heel above-noted. The kit in this preferred embodiment, includes the above-noted separate floor panels intermittently detachably mountable and securable on the afore-stated elongated floor-supports that extend between and are mounted on the at-least one forward transversely-extending beam and the at-least one rearward transversely-extending beam.

In another preferred embodiment, there is provided a detachable daggerboard well-structure and associated mechanism thereof (i.e. a centerboard arrangement) with a detachable daggerboard (centerboard) detachably mountable within the well defined by the daggerboard well-structure; the daggerboard well-structure is preferably mountable and securable between left and right panels of the floor preferably within the same aforestated through-space and preferably rearward of the mounting position of the masthead-heel. In this embodiment, the kit additionally includes the intermittently detachably mountable and securable daggerboard well-structure and the aforestated daggerboard thereof detachably mountable and securable therein.

In another preferred embodiment, there is provided, more attached preferably to a forward face of the forward transversely-extending beam, a water-tight storage bag and support structure therefor, having opening and closure structure(s) and mechanisms thereof for gaining access to interior space thereof, and for sealing against wetting by water during use of the catamaran or wind-surfacing catamaran. Such space also preferably carries a life-preserver or itself is detachable as a life-preserver, adding safety to the overall combination, and may carry first-aid and emergency supplies such as flares, flash-light, and the like. Accordingly, the kit in this preferred combination additionally includes this intermittently mountable and anchorable water-tight bag (or other equivalent enclosure structure).

In another preferred embodiment proving especially improved anchoring, for the above-noted pontoon-securing bands, at-least one left-forward band, at-least one right-forward band, at-least one left-rearward band and at-least one right-rearward band each thereof have opposite band proximal and distal ends, and the proximal and distal ends thereof each have caps or enlarged heads detachably mountable and anchorable onto one of the opposite ends the respective afore-stated forwardly and rearward transversely-extending beams. For each of these particular preferred bands, the distal ends are extendable transversely of the pontoons afore-stated longitudinal axis and are each detachably mountable and anchorable onto a spaced-away portion of the same beam (to which the proximal end thereof is attached) to which the band proximal end is mountable and anchorable, critical to this preferred embodiment. More preferably, the distal portion of each of these particular bands each are split into an additional distal end thereof, with the additional end being mountable and anchorable onto the same beam-end to which the band proximal end is mountable or mounted and anchorable or anchored, whereby each of these particular bands has the split, separate first and second distal ends thereof mounted to each of a distal end and a central portion of a common one of the transversely-extending beams afore-stated. Thus, in this preferred embodiment, the kit includes these particular bands having the split distal portion split into separate distal ends separately attachable to different parts of a common transversely-extending beam.

In a further preferred embodiment, there is critically included enlarged heads or caps on each of the proximal and distal end(s) of the afore-stated at-least one right-forward band, the at-least one left-rearward band and the at-least one right-rearward band, and critically included receiving-structures such as receiving-through-spaces of and through the opposite ends of the afore-stated forwardly and rearwardly transversly-extending beams of which the receiving-through-spaces are band-anchoring through-space formed by band-anchoring circumscribing structure shaped to receive the enlarged heads at-least when the the inflatable pontoon(s) is/are in a substantially deflated (or less-than fully inflated state), but more preferably are critically not detachable nor removable from the anchored (locked) state of insertion, when the pontoon(s) is/are in a substantially fully-inflated state of being. The head(s) receiving structure is preferably an integral part of the respective forwardly and rearwardly transversely-extending beams afore-stated. Accordingly, in this preferred embodiment, the kit includes the bands having the enlarged heads and the afore-stated forward and rearward transversely-extending band having the afore-stated attaching (mounting) and locking (anchoring) structures.

In a further preferred embodiment, critically for this preferred embodiment providing improved stability and durability in an assembled state, at-least one, and more preferably each of at-least one forwardly and at-least one rearwardly positioned transversely-extending beams each having (including) intermediate downwardly-extending portion(s) lockable in an assembled-state between inward-portions of each of the spaced-apart pontoons when in a substantially inflated state of being.

The present invention has as one goal thereof, the elimination of inconvenience previously described. By this invention, the present kit may be assemble to provide rigid structures including the platform or floor above-noted in the assembled state, together with a mast, a daggerboard and a wing (wing-rudder) that permits "wind-surf" type navigation. Such wind-surfing portions are mounted as a part of the assemble combination solely if and when wind-surfing is intended, otherwise devoid of such accessories being satisfactory for conventional catamaran use with paddle(s) and/or oars.

As above-described, in an assemble state, in a preferred embodiment, the platform (floor) is constituted of two traverse beams, against which the two floats rest in an inflated state, and to which they are attached as above-described. In this mode of construction, the platform includes but is not necessarily limited to a mere floor, the floor serving as a support surface for the user. The floor is typically suspended from or fixed on the two transverse beams as afore-stated, and preferably includes the two panels—typically two planks, disposed preferably symetrically or bilaterally in relation to the central longitudinal length-axis of the overall-catamaran. Also as afore-stated, these two planks are position so as to leave the free through-space along a central longitudinal length-axis of the overall catamaran—i.e. half-way between the spaced-apart pontoons in the mounted state. While the floor is suspended form and/or affixed (anchored) to the transversely-extending beams as afore-stated, it may additionally rest on and be attached to the pontoons, in the assembled state.

An advantageous way of suspending these planks or panels from the transverse beams consists of hanging them on the afore-stated elongated support beams—typically two parallel bars, which are as afore-stated preferably affixed in the transversely-extending forwardly and rearwardly positioned. However, it is possible to alternately and/or also affix the forward and/or rearward ends of these plank/panels directly onto/into the forwardly transversely-extending beams.

In the afore-stated wind-surfing embodiment in the assembled state, the two planks or panels in spaced-apart relationship to one-another serve to provide a slot of through-space adept to receive and mount the mast-head-heel above-noted, for the mounting and anchoring thereof, as well as the daggerboard well and daggerboard also as above-noted. While not specifically disclosed, any desired and/or conventional mast and sail or suitable dimension(s) may be utilized, as a part of the final combination, for detachable mounting thereof for the wind-surfing embodiment. Likewise, there may be provided conventional-type oar lock-well provided as a part of or accessory mountable detachably onto one or more of any of the catamaran, transverse beam(s), floor or the like.

In the wind-surfing embodiment for fixed-type navigation as afore-stated, the wing is fixed to the distal end of a pole of which the proximal end thereof is fixed on the rear transverse beam, in the mounted assembled state of the kit. As above-noted, the pole can be also mounted on the accessory mounting structure from rearward portions of the two spaced-apart inflated pontoons, in the assembled state of the kit.

In a simplified version of the invention, the floor is constituted of a single plank which preferably hangs on the two bars without necessarily resting on either or both of the spaced-apart floats in the inflated and assembled state, with the respective above-noted masthead-heel and being conventionally mounted on and/or through the floor-board or plank(s).

The invention may be better understood by making reference to the following figures each of which only diagrammatically and symbolically illustrate the invention, not unduly limiting the invention to solely the illustrated embodiments, and not being necessarily to any exact scale or dimensions.

THE FIGURES

FIG. 3 shows two partial views, one in perspective, and the other a cross-section, of the rear transversly-extending beam (traverse beam) and of the pole which carries the wing (wing-rudder).

FIG. 4 shows a partial view of one of the two traverse beams, as well as one of the two planks which constitute the floor, that is in the case where these planks are fixed directly on the traverse beams.

FIG. 5 shows a front view as well as a view from above the masthead-heel seen in FIG. 1.

FIG. 6 shows a view from above as well as two cross-sections of two different types of traverse beams conformable to the invention.

FIG. 7 shows a cross-section of one of the two traverse beams (the front transverse beam shown in FIG. 1) joined to one of the two floats and equipped with its system of bands (grips) which enables it to attach the pontoon(s) (float(s)).

FIG. 8 shows a view in perspective of a daggerboard well not incorporated in one of the two transverse beams but positioned and mounted and secured (anchored) between the two planks (panels) which form the floor in this embodiment, as detachably assembled.

FIGS. 9 through 12 show overall view and/or detailed views of variations in preferred embodiments of the invention, in which, for example, the floor is constituted of a single plank or panel that in this instance does not rest on the pontoon(s) (floats).

DETAILED DESCRIPTION

Figure 1:
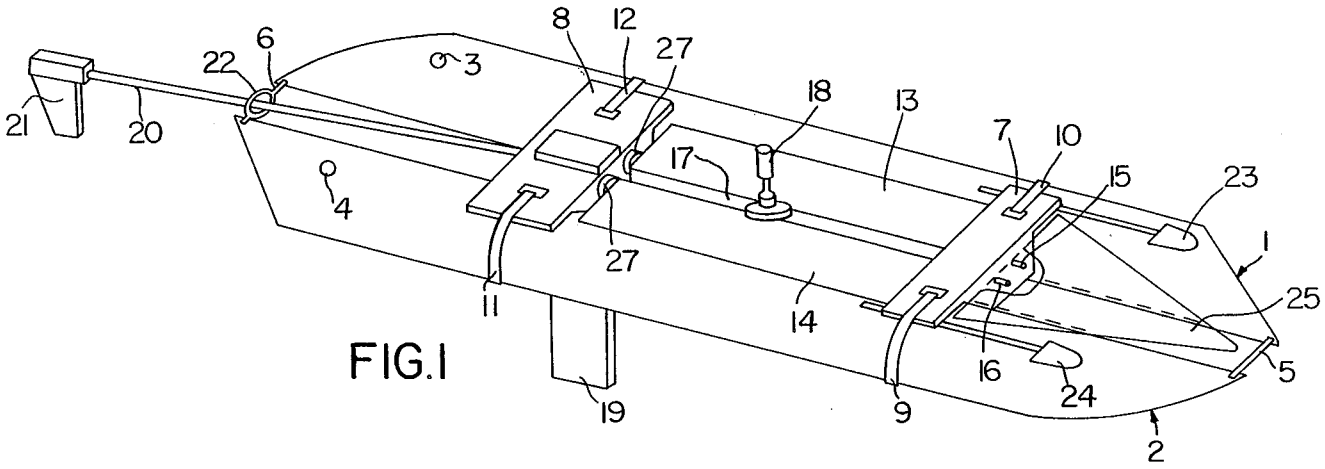
FIG. 1 shows a view in perspective of a pneumatic catamaran conformable to this invention in an assembled preferred embodiment thereof, equipped for the practice of "wind-surf" type navigation.

It is immediately evident in FIG. 1 that the catamaran, as assembled detachably, in accord with the precedingly described invention, that the improved combination includes the two independent preferably cylindrical-type inflatable pontoons (floats) 1 and 2. These floats, which are of the inflatable type, are constituted by two supple (flexible/yieldable) waterproof envelopes or enclosures which can be intermittently filled with air typically by valves 3 and 4.

Each of the two floats 1 and 2 presents extremities in the form of typically oblique cones, whose points are located on the same forward-pontoon (generator) structures. The two generators which carry the points of the cones are placed near each other and also the two floats are typically linked together detachably at the level of these oblique pointed cones by typical fastenings 5 and 6. The fastenings can be rigid, but can also be of supple texture, made for example by any kind of rope.

These two floats (pontoons) 1 and 2 are also liked together by principally the two transverse forward and rearward transverse beams 7 and 8. The overall linkage between these transverse beams 7 and 8, and the floats, is effected by the flexible gripes (bands) 9, 10, 11 and 12.

Two planks (panels) 13 and 14 are placed between the two transverse beams 7 and 8 as the floor—providing a support surface for the user, which permits the user in particular to stay upright and to maneuver around the sail (in the case of "wind surfing" type navigation). The ensemble of the two traverse beams 7 and 8, and the two planks 13 and 14 constitute the platform of the catamaran.

To enable them to support the weight of the user(s), these two planks 13 and 14, are hung and suspended on two bars 15 and 16, which can, for example, be constituted of aluminum tubing. These two bars are fixed in traverse beams 7 and 8. The two planks also rest on the floats the length of the planks's opposite sides to those which are hung on bars 15 and 16.

In another connection, it is evident that the two planks 13 and 14 are slightly separated from each other and from the longitudinal central lengthwise axis of the catamaran. They thus form a free space 17 therebetween in which an articulated foot for a surfer-user may be intermittently placed and fixed, which is designed to receive the mast with its sail and wishbone (not shown in the design). Thanks to this free space 17, the two planks 13 and 14 constitute a path along the length of which the masthead-heel 18 can slide, after which it can be immobilized at any distance from transverse beams 7 and 8.

At the back of the catamaran, the traverse beam 8 is equipped with a daggerboard well (typically 29 or 56) and cavity (through-space) 58 thereof, on and within which daggerboard 19 is placed and by which the daggerboard is supported. This traverse beam 8 is also linked to a pole 20 which carries a wing 21. This pole is kept on the vertical plane which contains the longitudinal axis of the catamaran by virtue of to the buckle 22 of the fastening 6. If this fastening is made with the aid of a rope, the buckle 22 can simply be made by rolling this rope around the pole 20 and immobilizing it by a knot.

To complete this boat, we can see, still on FIG. 1, that the catamaran can be equipped within the accessory two oars 23 and 24. These oars are immobilized by being bound or held intermittently against the inflated floats thanks to transverse beam 7 for example. The arms of these oars are placed on the median planes of each of the floats 1 and 2, this disposition offering the advantage that when the oars are not in use for rowing, they serve to reinforce the vertical rigidity of the front part of these floats.

Finally, still with regard to FIG. 1, a bag 25 is shown in partial cut-away view, which is situated at the front of the catamaran. This bag has the shape of typically a triangle, whose angles are typically equipped for example with rivets, are detachably linkable to fastening 5 and to the traverse beam 7. (The conventional typically hollow rivets as well as connections therefor, are not shown, not being critical to the invention.) This bag is equipped with a closing for which it would be advantageous to use a zipper, since this kind of closing would assure the watertightness of the bag, the bag itself being water-tight and water-resistant.

This bag 25 if placed as indicated in FIG. 1, aside from the advantage of enabling the user to bring along diverse objects, also enable him to protect himself from spray or projections of water, and also serves as a point of support for a second user, such as a passenger for example, who may be seated thereon typically facing toward the front of the vessel.

Figure 2:
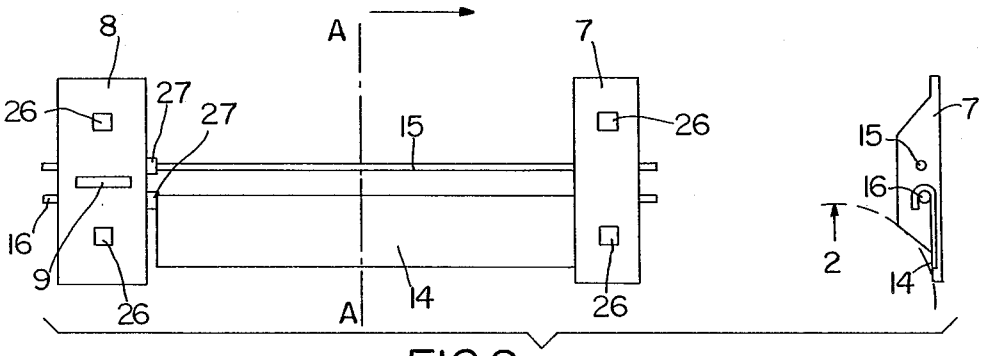
FIG. 2 shows a partial view, from above, of the platform of the catamaran represented in FIG. 1, as well as a cross-sectional view of that platform.

FIG. 2 shows more clearly the different constitute elements of the platform, which is shown in FIG. 1. First of all, in FIG. 2, a view of the platform from above is shown, without the floats and equipped with only one of the two planks which constitute the floor (plank 14, for example). A cross-section taken of this view from above at points AA is also shown, together with a partial representation, shown by means of a dotted line, of one of the two floats (float 2).

It can be seen, in FIG. 2, that the tranverse beams 7 and 8, are shown without the gripes (bands) 9, 10, 11 and 12, and have rectangular windows (i.e. receptacles for the enlarged heads of the proximal and distal ends of the bands, such as 26, in which the proximal and distal ends of the bands may be anchored detachably. Also it may be seen that each of two bars 15 and 16 may be equipped with a columnar portion possibly stepped, enabling each bar to be seated within a through-space channel in the beam 7 with the channel extending transversely of the beam 7. The transverse beam 8 is positioned by virtue of planks 13 and 14, to enable the planks to form a floor of the platform.

FIG. 3 shows a detailed view in perspective and a detailed cross-sectional view of transverse beam 8 and of the end of the pole 20, which is opposite the end carrying the wing 21. It has already been indicated that buckle 22 of fastener 6 keeps the pole 20 at the median longitudinal plane of the catamaran. FIG. 3 shows a simple solution for preventing wing 21 from turning around the axis of the pole 20. To obtain this result, extremity 28 of the pole has been flattened and folded. Also, traverse beam 8 (which contains the daggerboard well 29, which is partially shown) has been equipped with a rectangular housing 30, of which dimensions are slightly larger than the cross-section of the flattened extremity 28.

The partial cross sectional view of FIG. 3 (shown at the vertical median of the catamaran) shows how assembly 28 can be assembled inside the housing 30, of traverse beam 8. It is easy to see how this kind of assembly prevents pole 20 from pivoting in relation to traverse beam 8.

FIG. 4 shows a partial view in perspective of either of the two extremities of either plank 13 or plank 14, in a variation of the invention in which bars 15 and 16 have been eliminated. The profile of the plank shown in FIG. 4 is constructed in such a way that it can penetrate into the appropriate alveoles 31, which are located in the traverse beams (two of these alveoles as well as one of the extremities of these planks are shown in this figure). In this variation of the invention, this plank is fixed directly on this traverse beam, without passing by their intermediary of bars 15 and 16.

FIG. 5 shows a mode of construction of masthead-heel 18. This masthead-heel is designed to be placed and fixed in the free space which exists between planks 13 and 14. FIG. 5 shows this masthead-heel from the front and seen from above.

In addition to its articulated part 32 (which is similar to that of classical wind-surfing vehicles) this masthead-heel includes a circular collar 33 and a tongue 34 which are separated from each other by a crosspiece 35. In addition, two holes 36 and 37 are placed in the collar 33 at the two extremities of a symmetrical diameter of this collar. This diameter is perpendicular to the long sides of the rectangular tongue 34.

If the crosspiece 35 in cylindrical form has a diameter slightly smaller than the free space 17, and a height slightly greater than the width of planks 13 and 14, on the sides where they are hung on bars 15 and 16, it is possible to pass tongue 34 between these two planks and after a rotation of a quarter of a turn, to rest it under these two planks. The masthead-heel 20 can then be positioned at any place along the path constituted by space 17. To immobilize the masthead-heel in this position, without risk of it becoming unbolted, it suffices to link holes 36 and 37 to traverse beams 7 and 8, for example by means of two ropes. These ropes, stretched out, prevent the collar 33 from rotating a quarter turn once again. Such a rotation would disengage the collar from the path.

FIG. 6 shows a view from above and two cross-sections at points BB of transverse board 7 alone. (The cuts are considered to be made along the length of a vertical plane passing by the axis of one of the two bars 15 or 16). These two cuts show two different shapes for this traverse beam, first in the form of a "U", and the second, simpler, in the form of a "T". In each of these two modes of construction, holes such as 38, are placed in the wings of these profiles to permit the passage of bars 15 and 16. But in the case of the profile in "U", two holes are used for each one of the bars, because this profile includes two wings, only one hole being necessary for the profile in "T".

FIG. 7 shows the general disposition of one of the systems of grips (bands) which are designed to assure the connection between the tranverse beams and the floats. This figure shows, for example, the way float 2 is fixed against tranverse board 7, this same technique of fixing being used in symmetrical fashion for float 1 (the same system of gripes are used to link traverse board 8 to the two floats).

This FIG. 7 shows a cross-sectional view of traverse beam 7, in which only float 2 is shown. The plane of this cross-sectional view passes by the longitudinal axis of the traverse beam, and thus, in between the two window 26. Flat 2 is surrounded by a gripe 39 which encircles it almost completely. The two extremities of this gripe end in cap or enlarged heads 40, with the bands (gripes) for example in cylindrical form, are each designed to be slightly longer than the sides of the rectangular windows 26 and are parallel to the lengthwise longitudinal axis of the catamaran. These head or caps 40 can pass into and be hung on the windows that correspond to them, on condition that these caps are hung on these windows when the float 2 is at-least partially inflated.

If gripe 39 is constructed to be slightly shorter than the length the circumference of float 2 (that segment thereof covered by the grip), which it must surround, it is evident that it must press against and thus be bolted on this circumference of float 2 when float 2 is substantially completely inflated, in order to obtain a first fixing (anchoring attachment) of the float 2 against the transverse beam 7.

But it is necessary that this fixing be reinforced by a second gripe 42, to prevent float 2 from separating from the two wings 41 of tranverse beam 7 (a single wing is visible in this figure). This second gripe 42 is attached to the first and is also terminated by a cap 40 which is attached to the first and is also terminated by a cap 40 which is fixed, like the two caps of gripe 39 in a window 43. This window can, for example, be placed in a partition 44 of transverse beam 7 to make it more solid. This partition would also be situated on the longitudinal plane of the catamaran.

In addition to the two holes shown in FIG. 7 which are designed to permit the passage of bars 15 and 16 when they must support planks 13 and 14, two other holes, such as 45, are also placed in the wings 41 of tranverse beam 7. Using these supplementary holes, it is possible to place and to fix the two bars lower and more separated from each other, which is particularly advantageous if you want to practive navigation by rowing, for example. It is, then, possible not to put in place planks 13 and 14 (or to put in place only one of them) and nonetheless to dispose of points of support below, for the feet of the navigator, these points of support being situated at the level of the two bars.

FIG. 8 shows a variation of the invention concerning the construction of the daggerboard well. One may wish to construt the two traverse beams in a simple and identical manner and for example, use two traverse beams similar to traverse beam 7. It is necessary, in such case, to plan for an independent daggerboard well, and an example of this kind of daggerboard well is shown in perspective view of FIG. 8. This daggerboard well 46 is designed to be placed in the free space 17*a* (between planks/panels 13 and 14), which is already used by the masthead-heel 18. This daggerboard well is to be positioned and immobilized in this space which forms a space or slot, by means similar to those used for the masthead-heel.

In FIG. 8, the daggerboard well is shown together with a partial view of plank 14. This plank is shown together with bar 16, cut vertically at the same level as the front part of the daggerboard well. This plank is fit into a groove 47 of this same well. This well 46 includes a cavity which permits the passage and the support of the daggerboard (not represented) and another groove 49—symmetrical to groove 47, to be supported on plank 13.

These supports on planks 13 and 14 at the levels of bars 15 and 16, are designed to prevent the rotation of the daggerboard well 46, under the effects of the pressure undergone by the daggerboard in the water. Because of this, these supports must be able to keep the daggerboard on a vertical plane.

FIGS. 9 through 12 show overall and detailed views of a simplified variation of the invention., in which the floor of the platform is constituted of a single plank 50, this plank still being hung on bars 15 and 16. These two bars are more separated than is the case in FIGS. 1 and 2 (they can, for example be fixed in the holes 45, which are shown in FIG. 7, and thus be placed lower than holes 38).

In the partial view in perspective shown in FIG. 9, as well as in the view from above in FIG. 10 (the wing 21, with its pole 20, are not shown in FIG. 10) as base 51 is assembled on plank 50 in association with a reinforcing plate 52, which is placed on the opposite face of plank 50, in order to reinforce the assemblage of this base (in principle, plank 50 is constructed using a thin material, aluminum sheeting for example). The length of the vertical axis of this base 51, as can bee seen is a cylindrical type of housing 53 designed to receive and permit the fixing (anchoring) of an articulated masthead-heel.

The assemblage of this base 51 on this plank 50, can be accomplished by means of rivets (not shown in this design). But the base can also be made adjustable longitudinally if, on plank 50, the holes for the passage of these assembly rivets are replaced by rectangular windows, whose longer sides are parallel to the longitudinal axis of the catamaran. Such window, placed on plank 50 can glide and permit the longitudinal displacement of base 51 in relation to traverse beams 7 and 8 (as was the case for the masthead-heel 18) on condition that the assembly rivets are not tightened.

Finally, still in the case of the simplified solution of the construction of the floor of the platform, two identical traverse beams can be used which do not include a daggerboard well. In such case, an independent daggerboard well would have to be planned for, one model of which is shown in FIG. 12.

FIG. 12 shows a view from above and a cross-sectional view, at points DD, of such a daggerboard well, which is designed to be assembled on plank 50 (only the part of this plank situated at the rear of the catamaran is shown). This assemblage can be accomplished by virtue of a group of rivets 55, for example and typically.

The cross-section at points DD of the above-noted view, shows that such a daggerboard well is composed of two half-wells 56 and 57, which can be identical and placed symmetrically in relation to a point on plank 50 which point is situated at the center of the daggerboard well 54. The cavity 58 which permits the passage and support of the daggerboard, is then, situated on either side of plank 50 which permits a better transfer onto this plank of the efforts of pressure sustained by the daggerboard.

Finally, we see in FIG. 12, that the plank forming the floor 50 has been shown folded the length of its shorter side (the one which is not hung on bars 15 and 16) and that it therefore includes a tongue 59, the length of this shorter side (a similar tongue, not visible in this design view) is constructed on the other shorter side of this plank). This tongue 59 permits the movement of the rigidity of plank 50, which forms the floor, and it also keeps bars 15 and 16 in place.

The simplified floor shown in FIGS. 9 through 12 is made all of one piece. But in a variation of construction of this floor, it could be cut transversally, in order to be constructed in two or more parts, identical for example. This arrangement would reduce space occupied and, in the case in which base 51 and the daggerboard well 54 are permanently fixed in place, would permit the displacement of the implantation of these accessories with regard to the two traverse beams, by means of turning these two half-planks.

It is within the scope of the present invention to make variations and modifications and substitution of equivalents as would be obvious to a person of ordinary skill in this art.

I claim:

1. A wind-surfing catamaran assembly, which comprises:

spaced-apart inflated pontoons, each pontoon having a forward end portion and a rearward end portion, said end portions of each of said pontoon members being obliquely-pointed cones having an inwardly extending terminal end, terminal ends of said forward and rear end portions of said pontoons being connected to each other;

spaced apart forward and rearward transverse beam members disposed between and mounted to said pontoons, said transverse beam members spatially-positioning said spaced-apart portions with respect to each other, said transverse beam members including downwardly extending plate portions including positioning orifices;

longitudinal support members disposed between said pontoons and extending between said forward and rearward transverse beam members disposed in respective positioning orifices thereof, said support members being fixedly positioned in said positioning orifices of said rearward transverse beam member thereby defining a cockpit area therebetween; and a floor member disposed in said cockpit area positioned on said support members between and within said pontoons and said transverse beam members.

2. The wind-surfing catamaran assembly as defined in claim 1 wherein said floor member is provided with a mastholder and is mounted to said longitudinal support members.

3. The wind-surfing catamaran assembly as defined in claim 1 wherein each of said transverse beam members includes a fastening channel on either side of a centerline thereof and wherein a flexible band member is coursed about a respective pontoon for cooperation with a respective fastening channel for mounting said transverse beam member to said pontoons.

4. The wind-surfing catamaran assembly as defined in claim 3 wherein each of said longitudinal support members is a rod formed with a stop element for engaging said positioning orifice in said rearward transverse beam member.

5. The wind-surfing catamaran assembly as defined in claim 2 wherein said floor member is comprised of parallelly-disposed platform elements mounted to respective support members and defining a longitudinal slot therebetween and wherein said mastholder is disposed in said slot in fixed relationship with said platform elements.

* * * * *